US008141308B2

(12) United States Patent
Cashman

(10) Patent No.: US 8,141,308 B2
(45) Date of Patent: Mar. 27, 2012

(54) PREFABRICATED CORNER POST

(76) Inventor: Daniel J. Cashman, Suffield, CT (US)

( * ) Notice: Subject to any disclaimer, the term of this patent is extended or adjusted under 35 U.S.C. 154(b) by 262 days.

(21) Appl. No.: 12/383,976

(22) Filed: Mar. 31, 2009

(65) Prior Publication Data

US 2010/0242387 A1 Sep. 30, 2010

(51) Int. Cl.
*E04B 2/00* (2006.01)

(52) U.S. Cl. ..... 52/287.1; 52/312

(58) Field of Classification Search ..... 52/287.1, 52/288.1, 58, 312, 459, 460, 470, 471, 716.1, 52/718.01
See application file for complete search history.

(56) References Cited

U.S. PATENT DOCUMENTS

| | | | | |
|---|---|---|---|---|
| 4,196,553 | A * | 4/1980 | Veach | 52/276 |
| 4,319,439 | A * | 3/1982 | Gussow | 52/288.1 |
| 4,706,426 | A * | 11/1987 | Rumsey | 52/232 |
| 4,903,449 | A * | 2/1990 | Ellingson, Jr. | 52/288.1 |
| 5,664,376 | A * | 9/1997 | Wilson et al. | 52/287.1 |
| 5,974,748 | A * | 11/1999 | Sciuga et al. | 52/287.1 |
| 6,341,458 | B1 * | 1/2002 | Burt | 52/287.1 |
| 6,354,049 | B1 * | 3/2002 | Bennett | 52/287.1 |
| 6,631,600 | B2 * | 10/2003 | Schiedegger et al. | 52/658 |
| 7,228,665 | B2 * | 6/2007 | Perry | 52/287.1 |
| 7,278,240 | B2 * | 10/2007 | Burkart et al. | 52/155 |
| 7,448,117 | B1 * | 11/2008 | Sauder et al. | 27/10 |
| 7,866,120 | B2 * | 1/2011 | Prenn | 52/835 |
| 2004/0118062 | A1 * | 6/2004 | Meijer et al. | 52/287.1 |
| 2005/0262784 | A1 * | 12/2005 | Justice | 52/287.1 |
| 2006/0185270 | A1 * | 8/2006 | Handley et al. | 52/169.14 |
| 2007/0266657 | A1 * | 11/2007 | Gembala | 52/288.1 |

* cited by examiner

*Primary Examiner* — Branon Painter
(74) *Attorney, Agent, or Firm* — Alix, Yale & Ristas, LLP

(57) ABSTRACT

A prefabricated corner post (10) and associated method for attachment to an external corner (106) on a building (100). An angled body (12) has adjacent panels (14, 16) that form an inner corner (18) having inner flat surfaces (20, 22) adapted to closely engage the building corner (106), and an outer corner (24) forming an outer flat surface (26) that extends to side edges (28, 30). A nailing flange (32, 34) extends from the inner flat surface of each panel beyond a respective side edge of the outer surface. A trim piece (36) closely conforms to and is slidable vertically along the outer surface between an installation position (38) and a final position (40). Each panel of the body has a through hole (42) from the outer to the inner surface at the final position of the trim piece. In the installation position of the trim piece the through holes are exposed for receiving screws to secure the body directly to the building walls, and thereafter the trim piece can be slid to the final position to cover the holes and screws.

8 Claims, 3 Drawing Sheets

PREFABRICATED CORNER POST

BACKGROUND

The present invention relates to building construction, and more particularly, to decorative corner posts attachable to corners formed by exterior walls.

In the construction or renovation of modern buildings having a classic or colonial style, decorative corner posts attachable to the exterior walls provide a cost effective technique for simulating structural corner posts. Such decorative corner posts can be fabricated by a supplier and delivered to the building site for installation before or after the wall exterior siding, depending on the type of post and whether the siding is wood or vinyl. The corner posts can be made of wood or cellular PVC. The latter is often preferred, because raw material of the desired color can be purchased, cut, and seam welded into intricate decorative designs.

With conventional corner posts of this kind, the installer drills pilot holes through the post for screwing or nailing the post against the converging walls. A careful installer would try to minimize the visibility of the fastening penetrations, but especially with pre-colored posts, any touch-up required after the installation adds to the labor cost of what should be a simple and straight forward installation.

SUMMARY

In a general aspect, the inventive concept is directed to attaching a decorative cover having a closely conforming trim piece to a vertically extending building structure, by first attaching the decorative cover with a fastener through holes in the cover, and then sliding the closely conforming trim piece along the attached cover until the trim piece overlays and hides the fastener.

Installation of a decorative corner post is simplified by a trim piece that is slidable between an installation position and a final position, selectively exposing and then covering holes through which the corner post is attached to the walls at the corner of the building.

In one embodiment, an angled body has adjacent panels that form an inner corner having inner flat surfaces adapted to closely engage the building corner, and outer flat surface forming an outer corner. A trim piece closely conforms to and is slidable vertically along the outer surfaces between an installation position and a final position. Each panel of the body has a through hole from the outer to the inner surface at the final position of the trim piece. In the installation position of the trim piece the through holes are exposed for receiving screws to secure the body directly to the building walls, and thereafter the trim piece can be shifted to the final position to cover the holes and screws.

In the preferred embodiment a nailing flange extends from the inner flat surface of each panel, beyond the side edges, so the nailing flanges are readily accessible.

In the associated method, the trim piece is shifted to the installation position to expose the holes, and the internal corner of the corner post is placed against the corner of the building. The corner post is attached to the walls through the holes, and then the trim piece is shifted into the final position.

A given corner post would typically have the flange extend over the full vertical height of the building corner, with the shiftable trim pieces and associated holes located at least at the top and bottom of the corner post.

It can thus be appreciated that the installation of a corner post according to the invention immediately hides all nail or screw penetrations, thus avoiding unsightly blemishes or the need to fill, sand, and touch up such penetrations.

The same inventive concept can be used to provide decorative trim pieces for columns, such as between a porch and the underside of an overhang or roof.

BRIEF DESCRIPTION OF THE DRAWING

A preferred embodiment will be described below with reference to the accompanying drawing, in which.

DETAILED DESCRIPTION

Figure 1:
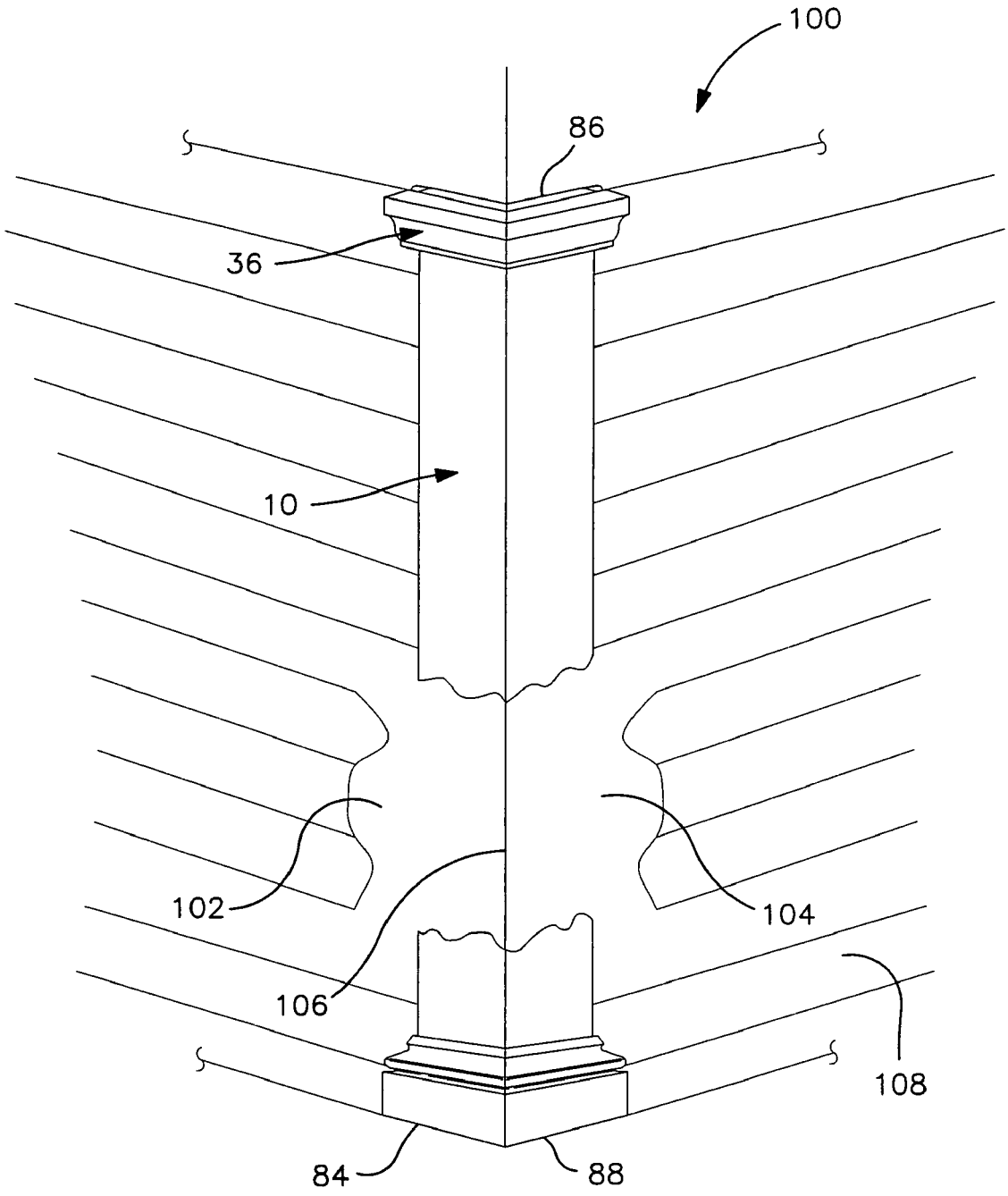
FIG. 1 is schematic view of an exterior corner of a building on which a corner post according to the invention has been attached.
Figure 2:
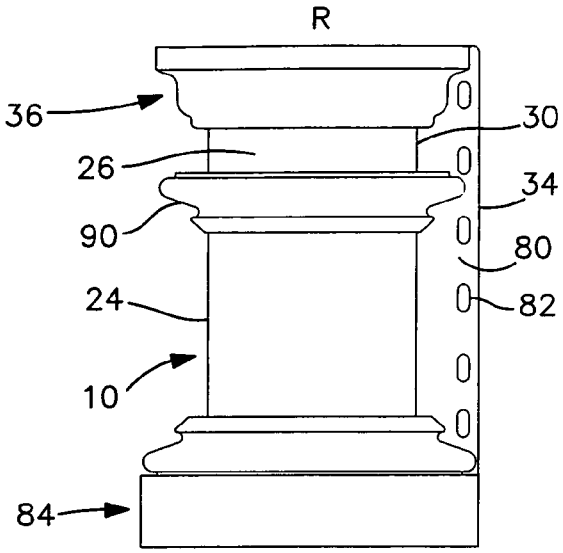
FIG. 2 is an elevation view of the outside of the corner post as viewed from the right of FIG. 1, before attachment to the building.
Figure 4:
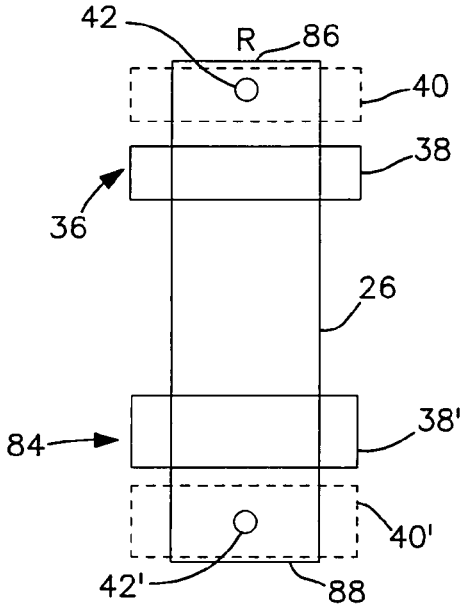
FIG. 4 is a schematic corresponding to FIG. 2, showing top and bottom trim pieces in the installation and final (phantom) positions.
Figure 3:
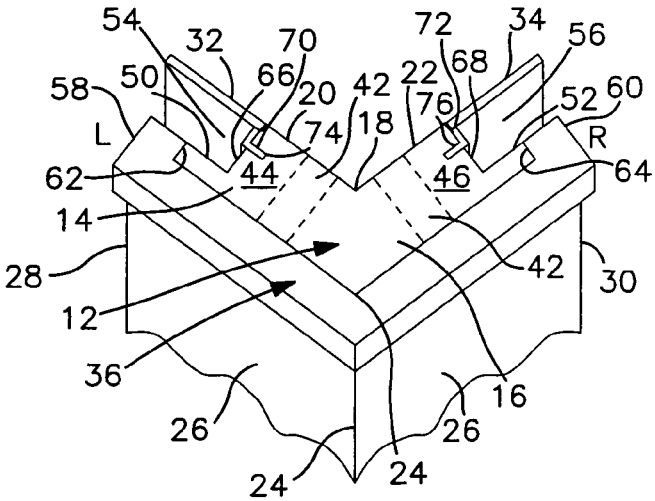
FIG. 3 is view of the top of the corner post, tilted forward, before attachment to the building.
Figure 5:
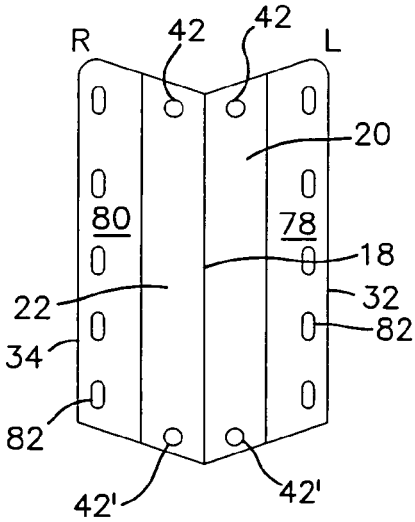
FIG. 5 is an elevation view of the corner post before attachment to the building, from the back.

FIG. 1 shows a decorative corner post 10 according to an embodiment of the present invention, attached to a building 100 having left 102 and right 104 exterior walls that meet at vertical corner 106 (shown where the post has been cut away). The post 10 does not provide structural support for the building 100 or walls 102, 104, but is adapted to abut with or receive edges of wood or vinyl siding 108. The present description will focus on an embodiment suitable for use with vinyl siding.

As shown with further reference to FIGS. 2-5, the post 10 includes an angled body 12 having adjacent panels 14, 16 that form an elongated inside vertical corner 18 having inner flat surfaces 20, 22 adapted to closely engage the elongated, outwardly protruding external building corner 106, and an elongated, outwardly protruding external corner 24 forming outer flat surfaces 26 that extend to side edges 28, 30. The outer surface remains visible after the corner post is attached to the building corner. Particularly for use with vinyl siding, but not required for use with wood siding, a nailing flange 32, 34 extends from the inner flat surface of each panel beyond a respective side edge 28, 30 of the outer surface.

A trim piece 36 closely conforms to and is slidable vertically along the outer surface between an installation position 38 and a final position 40. Each panel of the body has a through hole 42, preferably counter bored, passing from the outer to the inner surface at the final position of the trim piece. In the installation position of the trim piece the through holes are exposed for receiving screws to secure the body directly to the building walls, and thereafter the trim piece can be shifted to the final position to cover the holes and screws.

The post as described above is pre-fabricated and delivered to the building site, where the installer slides the trim piece to the installation position 38 to expose the holes 42, then places the post against the building corner as shown in FIG. 1, whereby the internal corner 18 of the corner post is against the corner 106 of the building. The corner post is attached to the walls 102, 104 through the holes 42 via fasteners such as screws or nails, and then the trim piece is shifted to the final position 40.

The body 12 and trim piece 36 are preferably made of solid cellular PVC, whereas the flange is preferably made of a semi-rigid vinyl.

Preferably, for use with vinyl siding, each body panel 14, 16 includes a thicker base portion 44, 46 in which the holes are located and which defines the inner surface that closely overlies the walls 102, 104 and a thinner rim portion 50, 52. The rim portions 50, 52 extend from of the base portions, and define the side edges 28, 30 of the outer surface 26, with a vertical channel 54, 56 formed between the base portion and the nailing flange. During installation, the flanges 32, 34 are nailed to the walls 102, 104 through holes 82, either before or after the post is screwed in through holes 42. The channels 54, 56 have a width similar to the overall thickness profile of vinyl siding, for receiving the edges of the vinyl siding. The depth of the channels provides sufficient tolerance for receiving edges on siding elements that may not all be exactly the same length, while presenting a uniform external interface between the siding and the side edges 28, 30 of the post.

In a further preference, a lateral edge 66, 68 of each base portion forms a bottom of a respective channel 54, 56, a groove 70, 72 extends vertically in the bottom of each channel, and the nailing flange has a fin 74, 76 that is secured via interference or press fit in the groove. A flat tab portion 78, 80 with a vertical row of nail holes 82 adjacent the outer edge is substantially coplanar with the inner surfaces 20, 22 of the body, whereby both the inner surfaces 20, 22 and the tabs 78, 80 of the nailing flange lie flat against the unfinished walls 102, 104.

The trim piece preferably has sides 58, 60 that extend beyond the side edges 28, 30 of the outer surface 26 and include guide surfaces 62, 64 slidable along the side edges (e.g., rim portions) of the outer surface. The sides 58, 60 also extend toward the nailing flange 32, 34, whereby the guide surfaces 62, 64 cooperate with the side edges 28, 30 to prevent the trim piece from pulling away from the outer surface of the body. To facilitate nailing of the flanges, the tabs 78 and row of holes 82 can extend laterally beyond the outer edges of the trim pieces, but this is not necessary so long as the row of holes is accessible laterally outside of the edges 28, 30 of surface 26.

Typically, one trim piece 36 with holes 42 is located adjacent the top 86 of the post and another trim piece 84 with holes 42' is located adjacent the bottom 88 of the post. Additional trim pieces such as shown at 90 in FIG. 2 can also be provided with similar installation functionality.

The body 12 is preferably uniform at least adjacent the top 86 and bottom 88 of the post, such that during fabrication (or even on site) the top 36 and bottom 84 trim pieces can easily be fit onto the body with the sides 58, 60 of the trim pieces positioned in close relation with the rims 50, 52. As is evident from FIG. 3, once this close relationship is established, the trim pieces 36, 84 can be shifted centrally away from the top and bottom, respectively, with the guide surfaces 62, 64 preventing the trim pieces from pulling away from the body.

Figure 6:
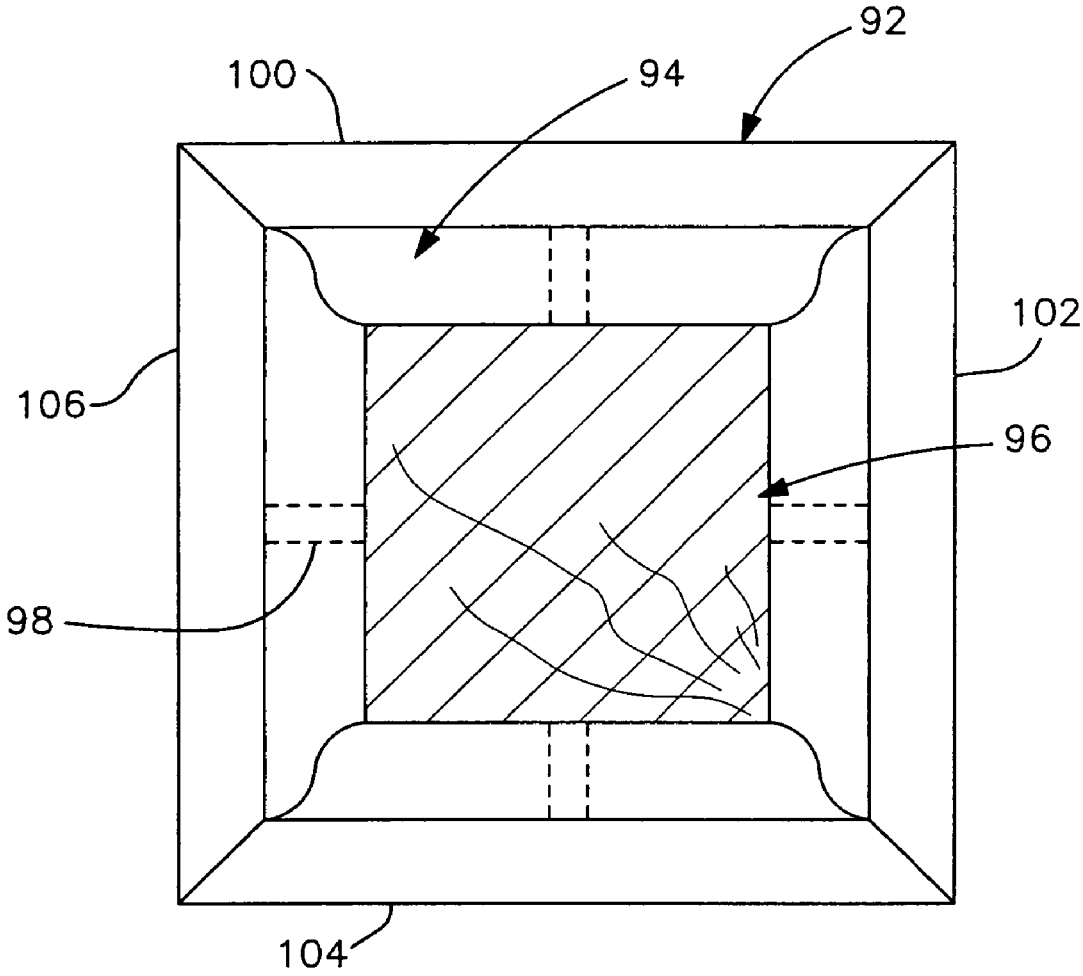
FIG. 6 shows an embodiment on a column.

FIG. 6 shows a schematic top view of a square trim piece 92 around a square decorative column cover 94. The structural column 96 can be solid (as shown) or boxed by the rigid connection of four elongated, flat boards. Preferably, the decorative column 94 with at least top and bottom trim pieces 92 carried thereon, are delivered as integrated units to the site, pre-cut to a standard or custom-ordered length. The holes 98 on each trim piece element 100, 102, 104, 106 correspond to holes 42 in the other Figures.

What is claimed is:

1. A prefabricated corner post having a top and a bottom, comprising:

an angled body extending vertically from the top to the bottom of the post, having adjacent panels defining inner flat surfaces that form an elongated internal corner, and outer flat decorative surfaces that form an elongated external corner;

a through hole from the outer to the inner surfaces of each panel;

a trim piece closely conforming to and slidable vertically over the outer surfaces toward and away from the top and bottom between an installation position at which the through holes are exposed for receiving fasteners and a final position at which the through holes are covered; and a nailing flange extending in parallel from the inner flat surfaces of each panel;

wherein each nailing flange has nail holes and extends from each panel beyond respective side edges of the outer surfaces.

2. The corner post of claim 1, wherein one slidable trim piece and associated through hole are located adjacent the top of the post and another slidable trim piece and associated through hole are located adjacent the bottom of the post, whereby when the trim pieces are in the final positions adjacent the top and bottom of the post, respectively, the outer flat decorative surfaces of the post are visible between the trim pieces.

3. The prefabricated corner post of claim 1, wherein:

said inner flat surfaces are adapted to closely engage an external building corner, while said outer surfaces remain visible after the corner post is attached to the building corner;

a nailing flange attached to each of the adjacent panels and extending from the inner flat surfaces of each panel beyond a respective side edge of the outer surface;

the trim piece having sides that extend beyond the side edges of the outer surface and including guide surfaces closely conforming to and slidable vertically along the outer surface between an installation position and a final position;

wherein each adjacent panel includes a thicker base portion in which said through holes are located and which defines said inner surface, a thinner rim portion extending from the base portion and defining a side edge of the outer surface, and a vertical channel formed between the rim portion and the nailing flange;

whereby in the installation position of the trim piece the through holes are exposed for receiving fasteners to secure the body directly to the building walls, and thereafter the trim piece can be shifted vertically to the final position to cover the through holes and fasteners.

4. The prefabricated corner post of claim 3, wherein:

a lateral edge of each base portion forms a bottom of a respective channel;

a groove extends vertically in the bottom of each channel;

the nailing flange has a fin that is secured in said groove and a flat tab portion with nail holes, that is substantially coplanar with the inner surfaces of the body.

5. The prefabricated corner post of claim 3, wherein one slidable trim piece and associated through hole are located adjacent the top of the post and another slidable trim piece and associated through hole are located adjacent the bottom of the post.

6. A prefabricated corner post having a top and a bottom, comprising:

an angled body extending vertically from the top to the bottom of the post, having adjacent panels defining inner flat surfaces that form an elongated internal corner, and outer flat decorative surfaces that form an elongated external corner;

a through hole from the outer to the inner surfaces of each panel;

a trim piece closely conforming to and slidable vertically over the outer surfaces toward and away from the top and bottom between an installation position at which the through holes are exposed for receiving fasteners and a final position at which the through holes are covered; and a nailing flange extending in parallel from the inner flat surfaces of each panel;

wherein one slidable trim piece and associated through hole are located adjacent the top of the post and another slidable trim piece and associated through hole are located adjacent the bottom of the post, whereby when the trim pieces are in the final positions adjacent the top and bottom of the post, respectively, the outer flat decorative surfaces of the post are visible between the trim pieces.

7. The prefabricated corner post of claim 6, wherein:

said inner flat surfaces are adapted to closely engage an external building corner, while said outer surfaces remain visible after the corner post is attached to the building corner;

a nailing flange attached to each of the adjacent panels and extending from the inner flat surfaces of each panel beyond a respective side edge of the outer surface;

the trim piece having sides that extend beyond the side edges of the outer surface and including guide surfaces closely conforming to and slidable vertically along the outer surface between an installation position and a final position;

wherein each adjacent panel includes a thicker base portion in which said through holes are located and which defines said inner surface, a thinner rim portion extending from the base portion and defining a side edge of the outer surface, and a vertical channel formed between the rim portion and the nailing flange;

whereby in the installation position of the trim piece the through holes are exposed for receiving fasteners to secure the body directly to the building walls, and thereafter the trim piece can be shifted vertically to the final position to cover the through holes and fasteners.

8. The prefabricated corner post of claim 7, wherein:

a lateral edge of each base portion forms a bottom of a respective channel;

a groove extends vertically in the bottom of each channel; and the nailing flange has a fin that is secured in said groove and a flat tab portion with nail holes, that is substantially coplanar with the inner surfaces of the body.

* * * * *